US006755320B2

(12) United States Patent
François-Marie

(10) Patent No.: US 6,755,320 B2
(45) Date of Patent: Jun. 29, 2004

(54) APPARATUS DISPENSING RECHARGEABLE REFRIGERATING ELEMENTS

(75) Inventor: Franci François-Marie, Ormoy (FR)

(73) Assignee: Internova International Innovation Company B.V., Rotterdam (NL)

( * ) Notice: Subject to any disclaimer, the term of this patent is extended or adjusted under 35 U.S.C. 154(b) by 37 days.

(21) Appl. No.: 10/239,935

(22) PCT Filed: Mar. 29, 2001

(86) PCT No.: PCT/IB01/00517

§ 371 (c)(1),
(2), (4) Date: Sep. 26, 2002

(87) PCT Pub. No.: WO01/73703

PCT Pub. Date: Oct. 4, 2001

(65) Prior Publication Data

US 2003/0089729 A1 May 15, 2003

(30) Foreign Application Priority Data

Mar. 29, 2000 (FR) ..... 00 03934

(51) Int. Cl.[7] ..... G07F 11/00
(52) U.S. Cl. ..... 221/13; 221/150 R
(58) Field of Search ..... 221/150 R, 7, 221/13, 15, 281; 62/231, 158; 134/61, 107

(56) References Cited

U.S. PATENT DOCUMENTS 2,232,619 A * 2/1941 MacCartee et al. ..... 221/130
4,618,074 A 10/1986 Teglasy et al.

FOREIGN PATENT DOCUMENTS

| | | |
|---|---|---|
| DE | 32 15 627 A | 11/1983 |
| DE | 93 03 765 U | 5/1993 |
| FR | 2 258 671 A | 8/1975 |
| WO | 97 34264 A | 9/1997 |

OTHER PUBLICATIONS

Publication No. F.R. A–2 745 933.

* cited by examiner

*Primary Examiner*—Kenneth W. Noland
(74) *Attorney, Agent, or Firm*—Davis & Bujold, PLLC

(57) ABSTRACT

The invention concerns a dispensing apparatus (1) with high refrigerating power, for delivering to users refrigerating elements (10) capable of diffusing frigories over a relatively great lapse of time so as to avoid interrupting the cold chain, comprising an input and disinfecting module (2) arranged above the refrigerating and storage module (6). The input (4) and output (7) orifices of the refrigerating and storage module are located substantially in the same plane and in the upper part of the docule which further includes third transfer mechanism (9) designed to lift the refrigerating elements towards the output orifice.

17 Claims, 8 Drawing Sheets

APPARATUS DISPENSING RECHARGEABLE REFRIGERATING ELEMENTS

TECHNICAL DOMAIN

The present invention concerns an apparatus for dispensing rechargeable refrigerating elements, especially plates or packets containing a substance formulated to accumulate frigories, comprising at least:

an input and disinfection module for said refrigerating elements provided with an input opening, an output opening, and a first means for transferring said elements between the two orifices; and a refrigeration and storage module for said refrigerating elements provided with an insulated case, a cold generating device for charging said refrigerating elements with frigories, an input orifice corresponding to the output orifice of said input and disinfection module, and an output orifice, said orifices traversing a wall of said insulated case; and with a second transfer means using gravity to transport said refrigeration elements for recycling inside said refrigeration and storage module.

PRIOR ART

It is well known that a regard for maintaining the temperature of frozen products is essential, since health threatening micro-organisms can develop very rapidly. In practice, with sensitive products such as ground beef there should be virtually no health threatening toxins or micro-organisms present, not even in minute amounts. At −10° C., bacteria stops multiplying completely. The risk of finding bacteria and pathogenic toxins is non-existent up to +3° C. Above that level, dangerous salmonella (+5° C.) and staphylococcus aureus (+6° C.) can multiply rapidly. Only scrupulously maintaining the cold chain eliminates these risks.

In order to maintain the cold chain on the way home over a substantial period of time, even during extreme summer heat, a consumer can currently place one or more refrigerating elements in an insulated container which holds fresh or frozen products just purchased. One or more of these refrigerating elements charged with frigories at −18° C. diffuses frigories throughput the insulated container. This maintains the temperature of the products without disrupting the cold chain. In order for the consumer to buy or obtain a refrigerating element charged with frigories, a dispensing device as defined above and known through Publication No. F.R.-A-2 745 933 is provided at the point of service. It dispenses and recycles these refrigerating elements. This dispensing device is found principally in large stores near the shelves of frozen products. In the realm of this application, a refrigeration temperature of −18° C. is sufficient.

This particularly simple, economical and non-polluting technology can be used prior to distribution, specifically to eliminate the use of dry ice when transporting frozen products. This application requires refrigerating elements of larger volume as well as a higher charge of frigories. For this purpose, the refrigeration temperature inside the refrigeration and storage module should be as low as −35° C., for example.

The dispensing apparatus known in the art does not achieve this objective, primarily because of cold escaping at the outlet orifice located on the lower portion of the dispenser.

DESCRIPTION OF THE INVENTION

The present invention proposes overcoming this disadvantage with a dispenser for high capacity refrigerating elements which dispenses and recycles refrigerating elements that can be placed in containers for transporting frozen products and which maintains the cold chain from the dispenser to the consumer's home.

To achieve this, the invention concerns an apparatus for dispensing refrigerating elements such as that described in the preamble, characterized:

in that the inlet and disinfection module is located above said refrigeration and storage module, in that the input and output orifices of said refrigeration and storage module are located in the upper portion of said module, and in that the refrigeration and storage module comprises a third transfer means for lifting the refrigerating elements to the input orifice.

Preferably the input and output orifices of the refrigeration and storage module are located in essentially the same plane.

In a preferred embodiment of the invention, the first transfer means comprises an inclined ramp which uses gravity to transfer the refrigerating elements from said input orifice to said output orifice.

The input and disinfection module may advantageously comprise a cleaning device comprising two circular brushes arranged symmetrically relative to said inclined ramp along the path of the refrigerating elements, each brush being attached to a motor drive rotating plate.

The input orifice may also comprise a presence detector designed to transmit a signal to the motorized element of the cleaning device when a refrigerating element is detected, said presence detector comprising an articulated angled finger subjected to a recall spring designed so that its free extremity is located at the rear of said input orifice on the trajectory of the refrigerating elements, and at least one micro switch.

Preferably, the input orifice of the refrigeration and storage module comprises a sealed door consisting of a flexible spline which opens under the weight of a refrigerating element.

In the preferred embodiment, the second transfer means consists of a helicoidal rail extending inside the case from the input orifice at the upper portion to the lower portion, the purpose of said rail being to receive said refrigeration elements which are generally vertical and in overlapping arrangement on its upper generatrix. In this case the input orifice of the storage and refrigeration module is located along an essentially vertical axis and the inclined ramp of the first transfer means forms an acute angle with the axis of said input orifice.

According to the preferred embodiment, the third transfer means comprises a guide tube extending inside the case from the lower portion thereof to its output orifice at the upper portion, and which receives the superimposed, vertical refrigerating elements with the lower portion of this guide tube comprising a window located opposite the lower extremity of the rail, as well as a lifting device for lifting the superimposed refrigerating elements inside said guide tube in order to accommodate a new refrigerating element arriving from the helicoidal rail; the lower extremity of the helicoidal rail is rectilinear and essentially perpendicular to the window in said guide tube.

The lifting device may comprise a retractable projecting element articulated to the extremity of a runner located in a support that is parallel to and behind the guide tube, said runner moving in a back-and-forth translational motion alternating between a lowered position and a raised position, with the projecting element moving between two positions, an exit position where it extends inside the guide tube while moving forward, and a returned position where it is retracted inside the support; and the lifting device comprises a stop which limits rotation by the articulated projecting element in its projecting position.

In the preferred embodiment, the articulated projecting element is essentially triangular in shape such that when it is extended, its upper surface is essentially horizontal, and when it retracts its lower surface is essentially vertical; the two surfaces together form an acute angle.

Advantageously, the outlet orifice comprises a sealed door designed to open when pushed by a refrigerating element stored in the guide tube, said sealed door sliding within an inclined support located outside said sealed case and comprising, at the extremity that blocks said output orifice, a bisected surface that generates a backward motion when pushed by said refrigerating element. In this case the output orifice is preferable disposed on a vertical axis and the inclined support forms an acute angle with the axis of this output orifice.

SUMMARY DESCRIPTION OF THE DRAWINGS

The present invention and its advantages will be more apparent from the following description of one non-limiting embodiment, with reference to the attached drawings, in which.

THE BEST WAY TO ACHIEVE THE INVENTION

Figure 1:
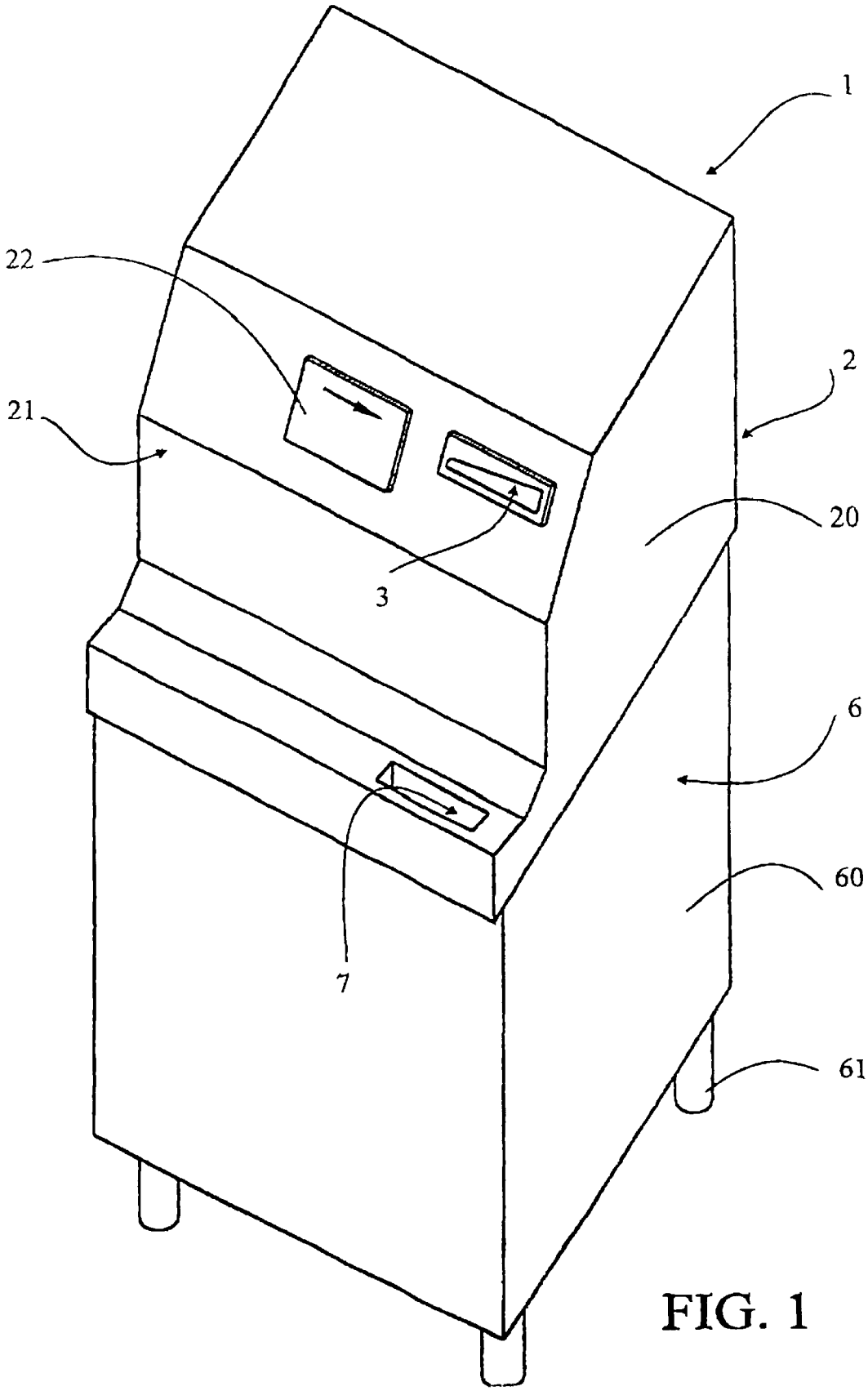
FIG. 1 represents a perspective view of the dispensing apparatus of the invention.
Figure 2:
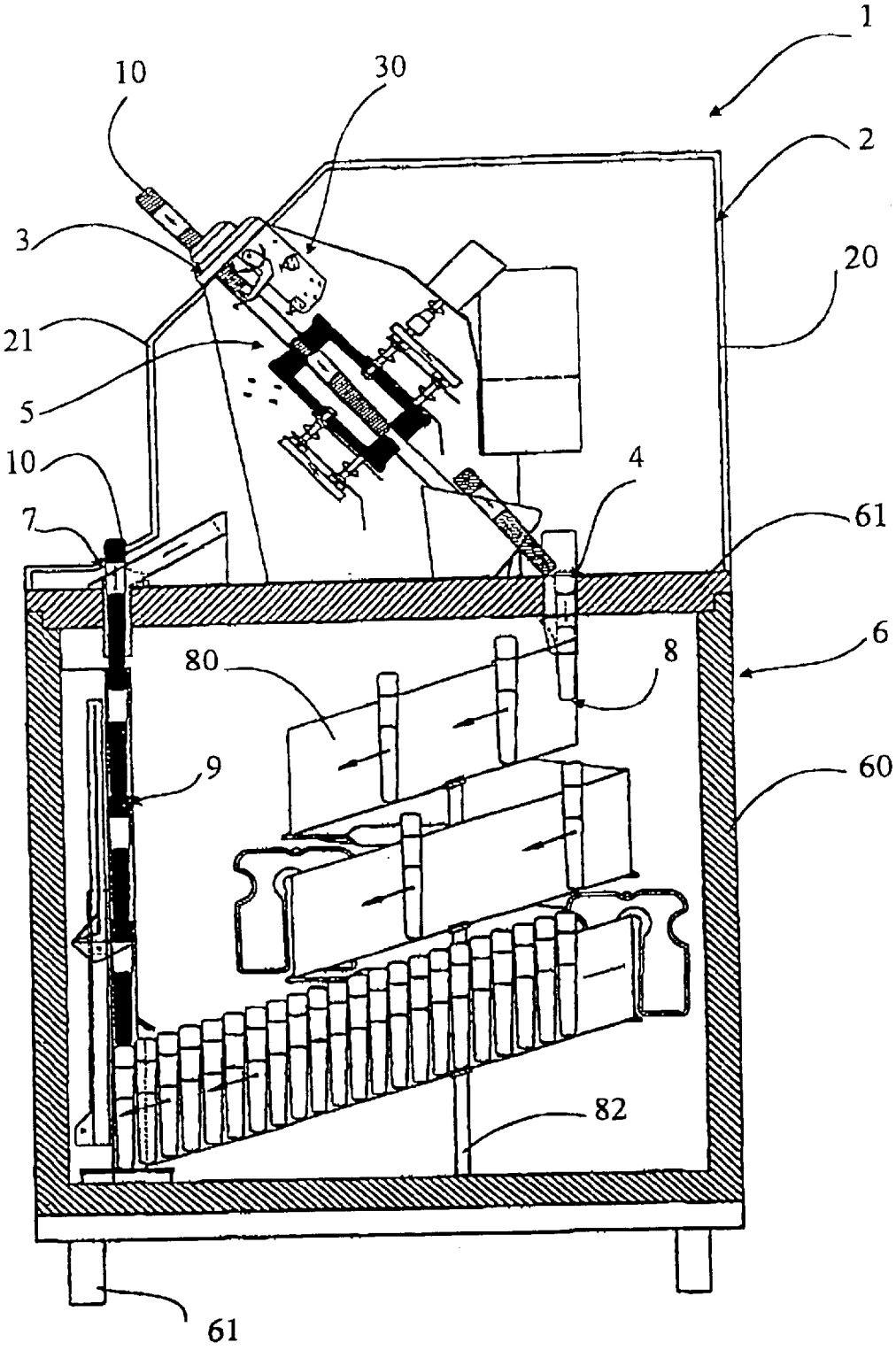
FIG. 2 is lateral cross-section of the apparatus of FIG. 1.

With reference to FIGS. 1 and 2, dispensing apparatus 1 of the invention, designed to dispense refrigerating elements 10 and to recharge recycled refrigerating elements with frigories, comprises the following two superimposed modules:

- in the upper portion, an input and disinfection module 2 for said refrigerating elements equipped with an input orifice 3, an output orifice 4 and a first transfer means 5 for transferring said elements between the two orifices; and
- in the lower portion, a refrigeration and storage module 6 for said refrigeration elements having an insulated case 60, a cold generating device (not shown) for charging said refrigerating elements 10 with frigories, an input orifice 4 corresponding to the output orifice of said input and disinfection module 2, an output orifice 7, said orifices traversing a wall of said insulated case 60
- a second transfer means 8 for transporting said refrigerating elements 10 to be recycled inside said refrigeration and storage module 6 by means of gravity, and
- a third transfer means 9 for lifting said refrigerating elements 10 from second transfer module 8 to the output orifice 7.

Refrigeration and storage module 6, which is generally cube shaped, rests on the floor with feet 61 and comprises a cold generating device (not shown) consisting of a conventional compressor, an evaporator, a condenser, and a recovery container. The input and disinfection module 2 are located above said module 6, thus forming a compact apparatus. Input module 2 is covered by an angled metal piece 20 defining a desk 21 on the front surface. On this desk 21 are located the input orifice 3 at the top right, the output orifice 7 at right median portion, and a communication and control post 22, which may comprise control buttons and indicator lights relating to the operation of dispensing apparatus 1, indicating the location of input orifice 3 with an arrow, and other information useful to the person operating dispensing apparatus 1.

In FIG. 2 it is very clear that input orifice 4 and output orifice 7 of the refrigeration and storage module 6 are located in essentially the same plane and at the upper portion. They traverse upper wall 61 of insulated case 60 along generally vertical axes. This particular arrangement of input orifice 4 and output orifice 7 at the upper part of insulated case 60, combined with the cubic shape of the case, advantageously prevents cold from leaking and consequently is conducive to increasing refrigeration temperature to as low as −35° C.

Figure 3:
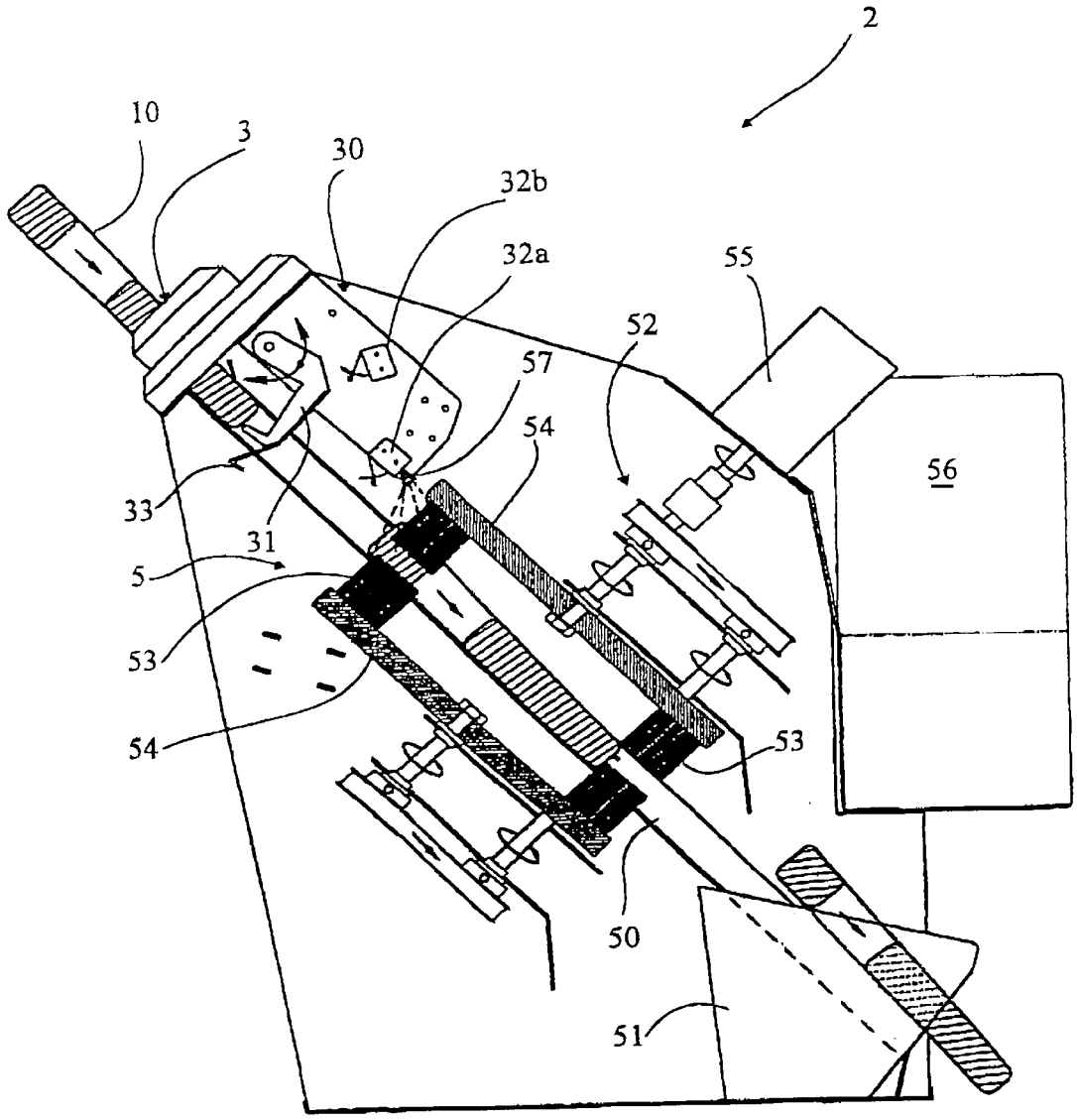
FIG. 3 is a detailed view of the input and disinfection module.

Likewise, with reference to FIG. 3, the input and disinfection module 2 comprise a first transfer means 5 consisting of an inclined ramp 50 forming a U-shaped rail that is generally equivalent in width to refrigerating elements 10. This inclined ramp 50 extends from input orifice 3 at the upper portion to the area of output orifice 4, at the lower portion, and forms an acute angle, for example a 45° angle, with the axis of said orifice 4. Thus, refrigerating elements 10 are transferred between these two orifices by simple gravity, sliding along this inclined ramp 50. The lower extremity of this inclined ramp 50 comprises two lateral flanges 51 designed to guide refrigerating elements 10 laterally when they leave inclined ramp 50 for introduction into input orifice 4, passing from an inclined position to an essentially vertical position by means of simple gravity.

On the trajectory of refrigerating elements 10, along said inclined ramp 50, there is a cleaning and disinfection device 52. This device 52 comprises, in the example shown, two circular brushes 53 that are symmetrically disposed relative to inclined ramp 50, each brush 53 being attached to a revolving plate 54 driven in synchronization by motorized means 55. Refrigerating elements 10 are displaced along inclined ramp 50 on the one hand by gravity and on the other hand due to the rotation of brushes 53. A reservoir of liquid disinfectant 56 is also provided for spraying said refrigerating elements 10 by means of nozzle 57 directing its stream toward brushes 53. Obviously any other cleaning and disinfection mechanism may be used.

Inlet orifice 3 has an opening that is equivalent in section to the transverse section of horizontally introduced refrigerating elements 10 This transverse section is intentionally not symmetrical in relation to the median axis of refrigerating elements 10 in order to orient them correctly inside apparatus 1. At the rear of said input orifice 3 there is a presence detector 30 comprising an angled finger 31, articulated and disposed so that its free extremity is situated on the trajectory of refrigerating elements 10, as well as a micro-switch 32*a* which transmits a signal to the actuating means for the runner of the lifting device described below in order to effect the exchange of refrigerating elements 10. For this reason, FIG. 31 extends into an activating rod 33 which engages micro-switch 32*a* only when finger 31 is pushed by a refrigerating element 10 according to the invention and located in the right direction, i.e., in a forward facing U. Obviously other detection means could be used, such as optical detectors, for example.

A second micro-switch 32*b* is also provided for transmitting a signal to motor 55 of cleaning device 52 when a refrigerating element 10 is detected.

Figure 4A:
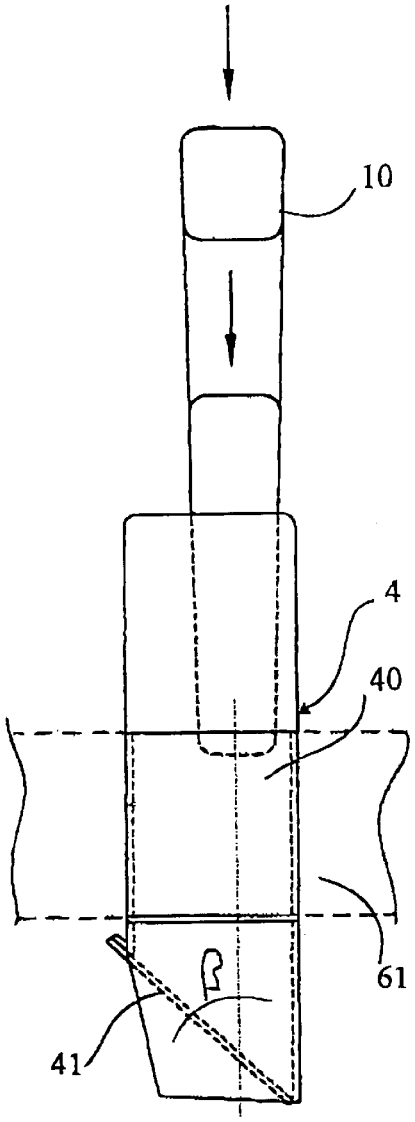
FIGS. 4A and 4B are detailed views of the input orifice of the refrigeration and storage module shown closed and open, respectively.
Figure 4B:
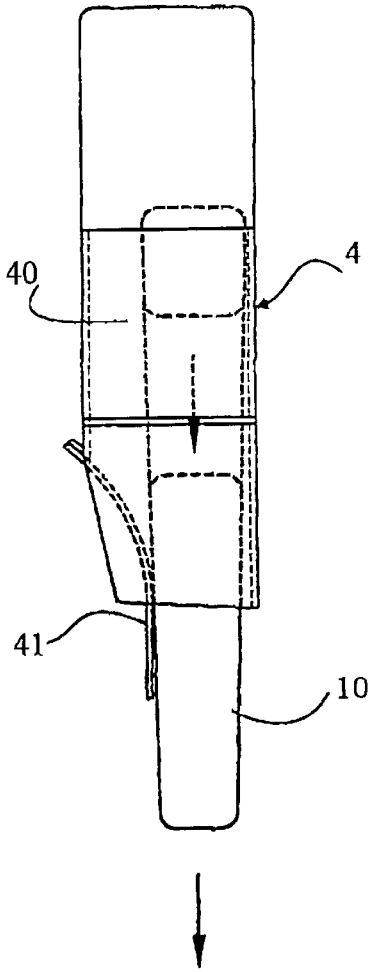
Figure 5:
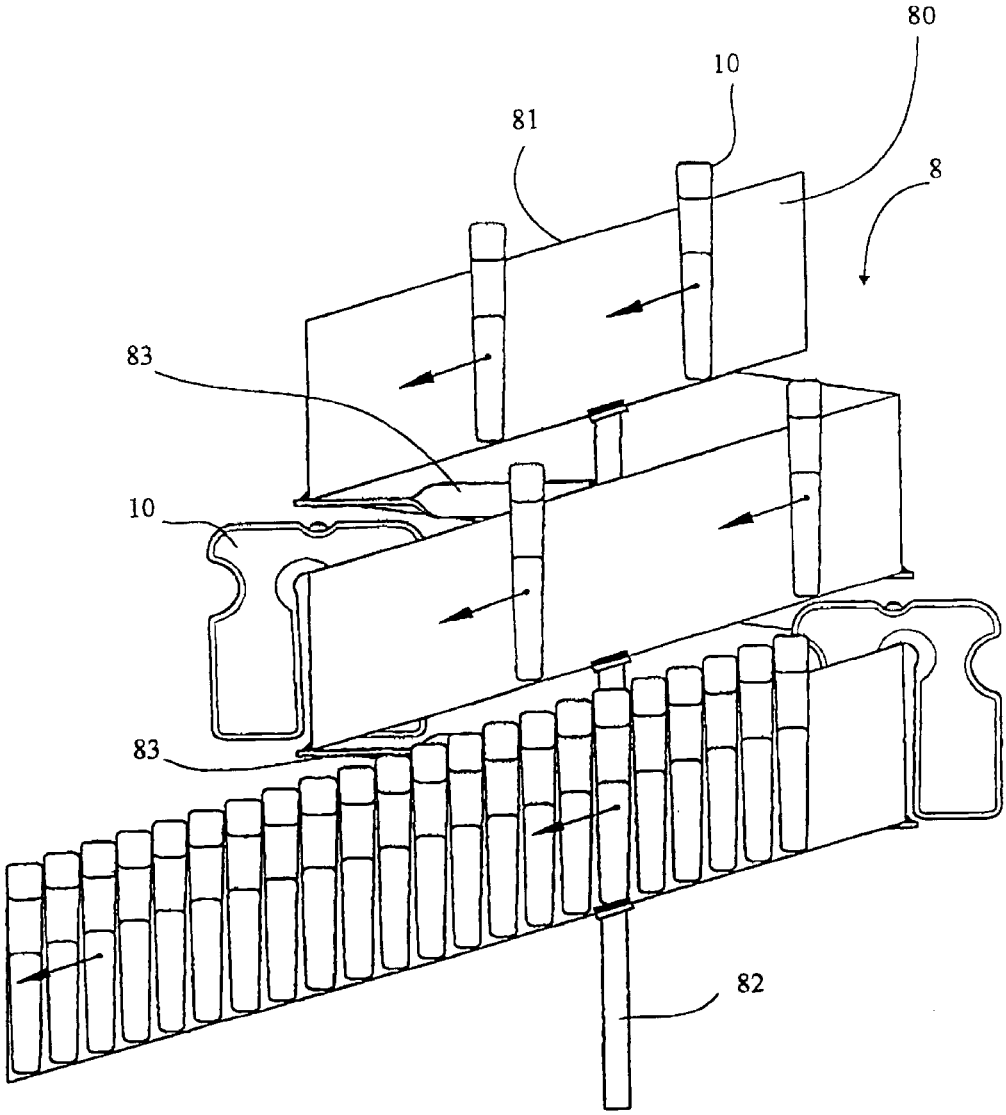
FIG. 5 is a detailed view of the storage rail in the refrigeration and storage module.

With particular reference to FIGS. 4A and 4B, input orifice 4 of refrigeration and storage module 6 comprises a parallelepiped chamber 40 located in an opening of corresponding shape in upper wall 61 of insulated case 60. This chamber 40 extends beyond either side of said wall 61 and comprises a sealed door 41 at the extremity located inside insulated case 60. This sealed door 41 consists of a flexible spline, one edge of which is connected to chamber 40 and the opposite edge of which closes chamber 40 in resting position, shown in FIG. 4A. This flexible spline 41 is inclined relative to the vertical axis of chamber 40 at an acute angle, for example, a 45° angle, and it opens under the weight of a refrigerating element 10 introduced inside chamber 40, as shown in FIG. 4B.

Above this input orifice 4 the upper extremity of a helicoidal rail 80 is located, forming the second transfer means 8 for transporting and storing said refrigerating elements 10 inside storage and refrigeration module 6. This helicoidal rail 80, flat in shape and with regular steps, extends inside the case from top to bottom, from its input orifice 4 to the bottom of insulated case 60. The spires that comprise this helicoidal rail 80 form an angle with the horizontal ranging from about 18° to 25°. To support said helicoidal rail 80, a support tube 82 is attached inside insulated case 60 coaxial to said rail and supporting shelves 83 attached to the interior generatrices of helicoidal rail 80, for example, every 90 degrees. Obviously it is possible to use other attachment means. Helicoidal rail 80 is made of metal and a defrosting system (not shown) may be installed in certain cases to prevent frost formation.

The upper extremity of helicoidal rail 80 is rectilinear and it is located below input orifice 4 in order to receive refrigerating elements 10 as the elements fall due to gravity, position themselves in overlapping arrangement on upper rail generatrix 81, and are guided laterally by lateral chamber walls 40 extending from either side of rail 80. The lower extremity of helicoidal rail 80 is also rectilinear in order to properly position refrigerating elements 10 in relation to the third means of transfer 9 which will be described below.

Figure 8:
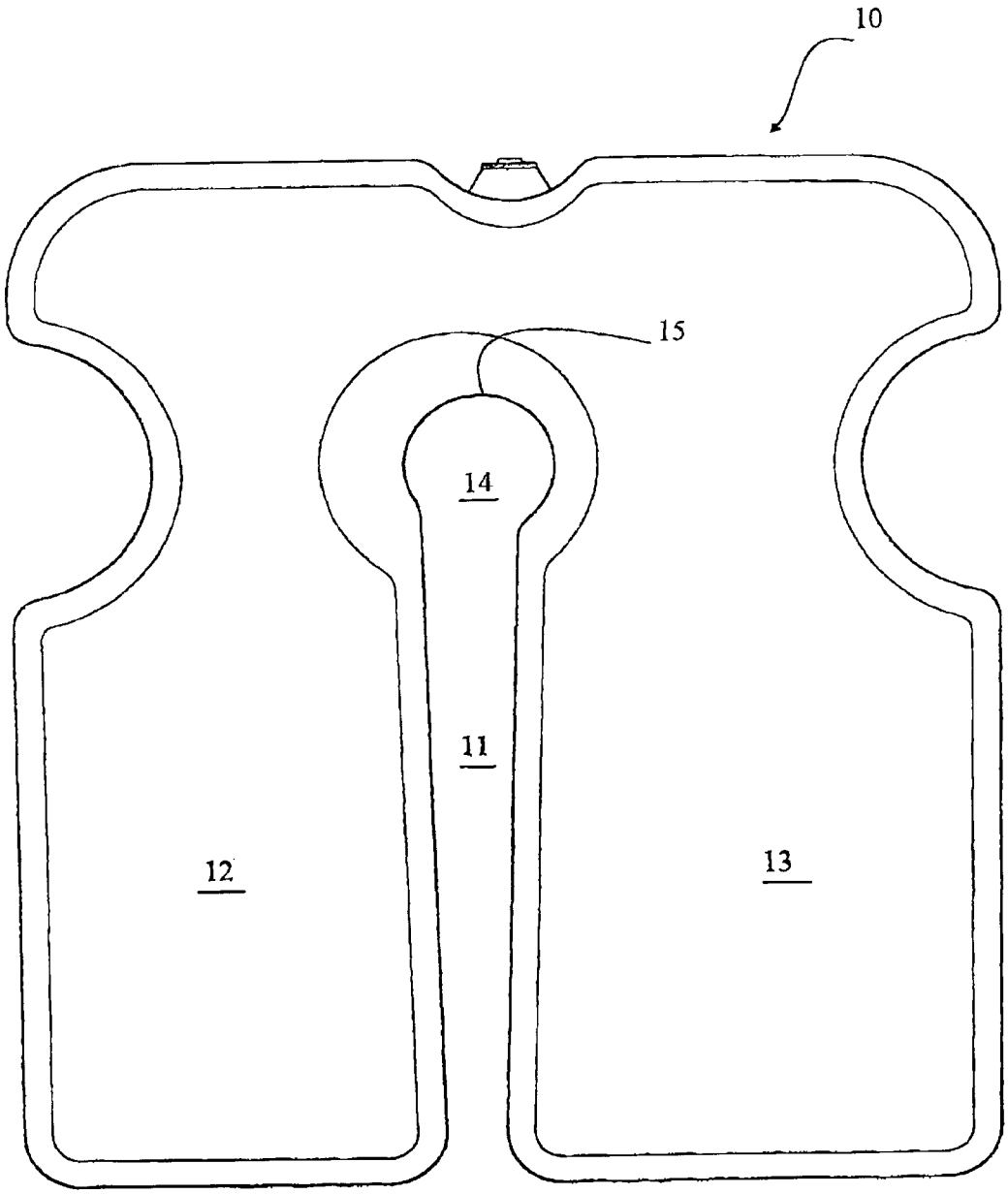
FIG. 8 is a surface view of the refrigeration element according to the invention.

Said helicoidal rail 80 permits refrigerating elements 10 to be stored in an essentially vertical position, one after the other, and to be displaced by gravity. FIG. 8 shows a plane view of refrigerating element 10. A detailed description of it appears in Publication No. FR-A-2 745 933. It takes the form of a generally parallelepiped plate and comprises, in particular, a slot 11 defining two branches 12 and 13, said slot being generally wider than the thickness of helicoidal rail 80 and tapering at the bottom. Said slot 11 is located beneath a traversing orifice 14 where the area of contact 15 with upper generatrix 81 of helicoidal rail 80 is located. The particular design of refrigerating elements 10 places the center of gravity of that element below this contact point 15 and it is axially offset near the wider branch 13 of the refrigerating element so as to equalize the distribution of the substance contained within refrigerating element 10 between branches 12 and 13. This substance is a eutectic mixture with a melting point of about −23° C.

Figures 6A, 6B, 6C:
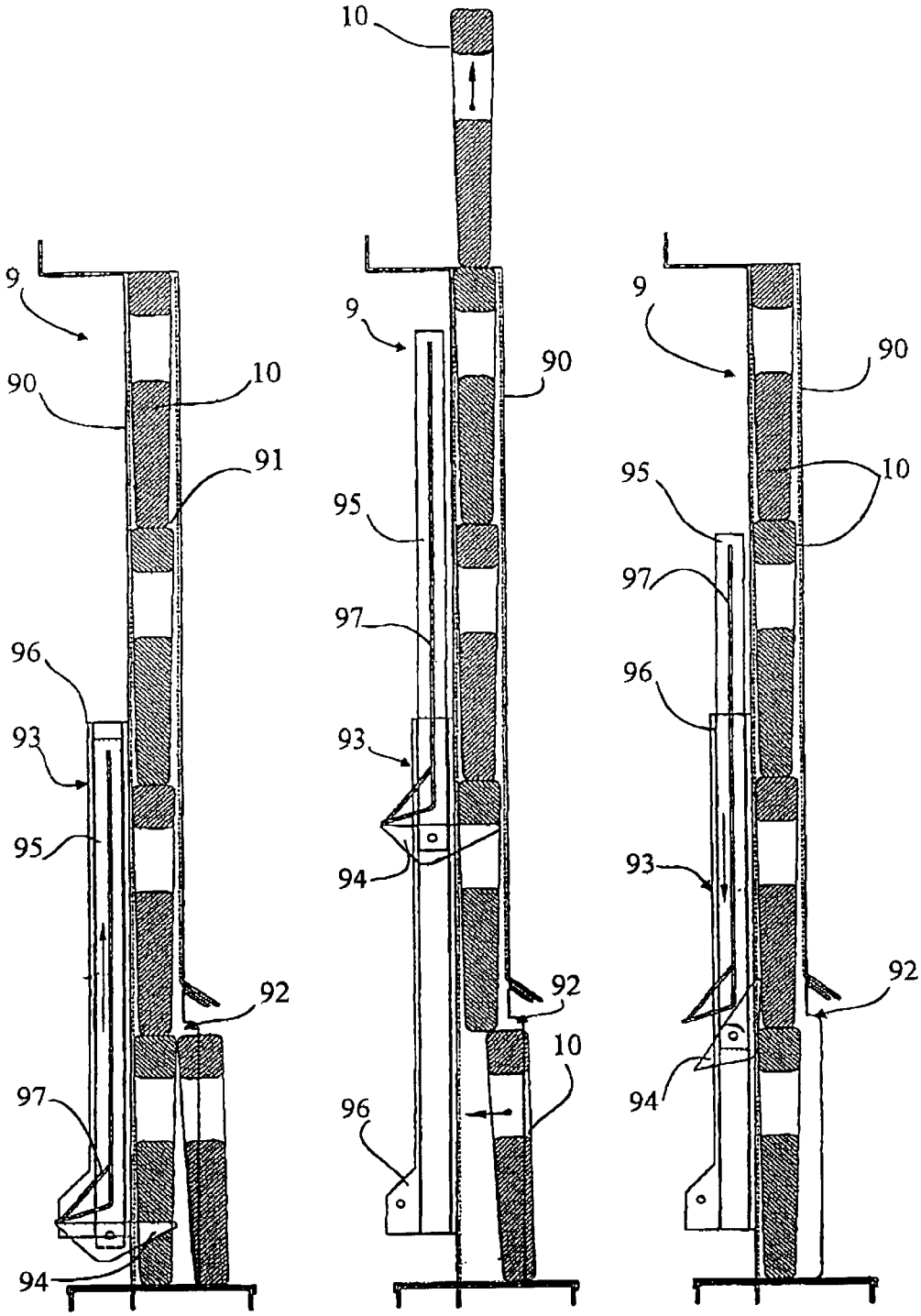
FIGS. 6A, 6B and 6C are detailed views of the third transfer means.

With reference to FIGS. 6A, 6B and 6C, the third transfer means 9 comprises a guide tube 90 extending inside insulated case 60 from bottom to top, from the base of the insulated case to output opening 7. It defines a rectangular interior passageway 91, the dimensions of which correspond to at least the largest section of refrigerating elements 10, for receiving these elements in vertical position, overlapping one another. The lower portion of this guide tube 90 comprises a window 92 perpendicular to the lower extremity of helicoidal rail 80. Said third transfer means 9 also comprises a lifting device 93 which lifts refrigerating elements 10 superimposed inside guide tube 90 in order to accommodate another refrigerating element 10 arriving from helicoidal rail 80 through window 92.

Lifting device 83 comprises a retractable projecting element 94 articulated to the end of a runner 95 located in a support 96 that is parallel to and at the rear of guide tube 90. This runner 95 is activated to move in alternate translation back and forth between a lower position, shown in FIGS. 6A and 6C, and an upper position, shown in FIG. 6B. Projecting element 94 moves between two positions, an extended position shown in FIGS. 6A and 6B, where it moves forward to project inside guide tube 90, and a retracted position shown in FIG. 6C, where it returns to retract inside support 96. A stop 97 consisting of a rod is attached to runner 95 behind projection 94 to limit its rotation in the extended position. This articulated projection 94 is generally triangular in shape so that when it is extended, it upper surface is generally horizontal and when it is retracted, its lower surface is generally vertical, with the two surfaces together defining an acute angle. Runner 95 may be moved by a cylinder (not shown) or any other equivalent means regulated by a control device such as a push button or a touchpad located on table 22 of desk 21, or by the microcomputer 32*a* of presence detector 30 when refrigerating elements 10 are exchanged.

Figure 7A:
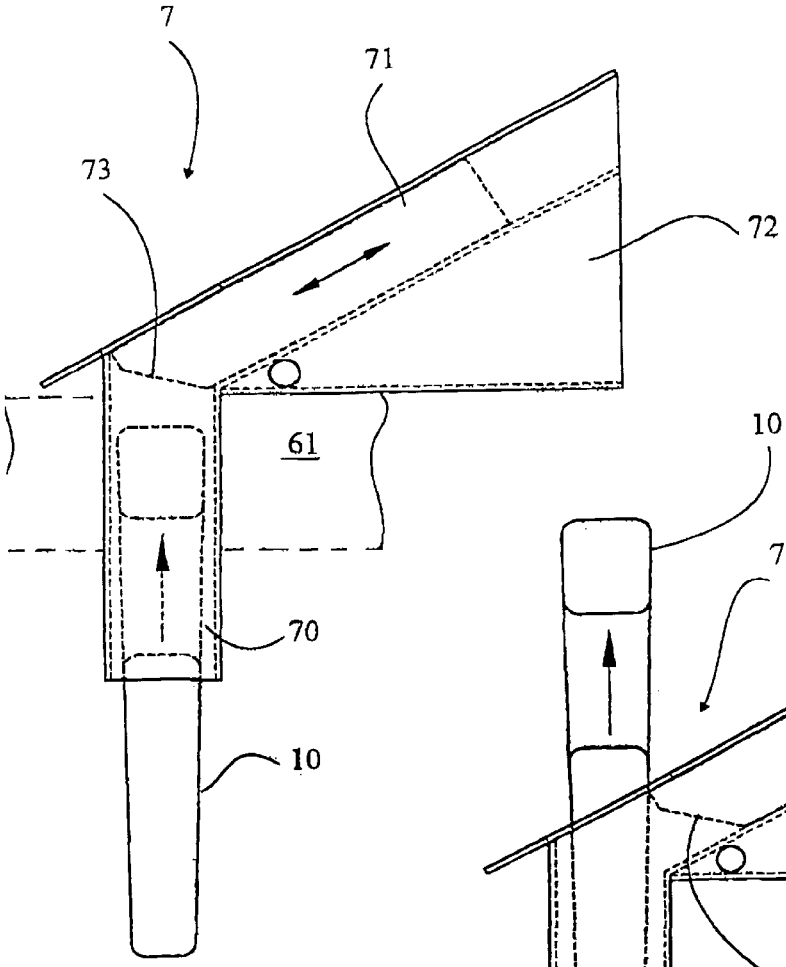
FIGS. 7A and 7B are detailed views of the output orifice of the refrigeration and storage module shown closed and open, respectively.
Figure 7B:
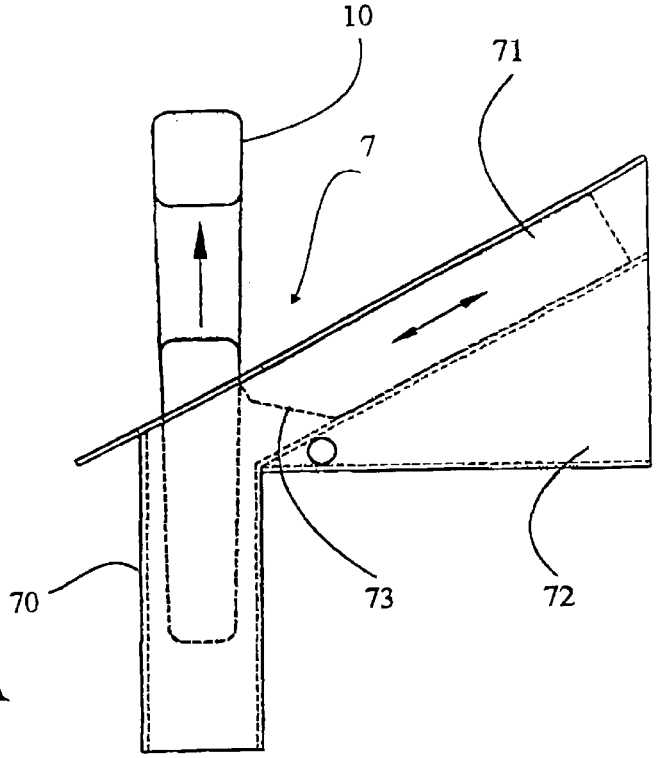

With reference to FIGS. 7A and 7B, output opening 7 comprises a chamber 70 traversing upper wall 61 of sealed case 60 from side to side as well as a sealed door 71 designed to open under pressure from a refrigerating element 10 when it is pushed by the other refrigerating elements stored in guide tube 90 and lifted by lifting device 93. Sealed door 71 slides inside inclined support 72 located outside sealed case 60. At the end which blocks output opening 7, door 71 has a bisected surface 73 so it can be pushed back by a refrigerating element 10. Output opening 7 is located on a generally vertical axis and inclined support 72 forms an acute angle with the axis of output opening 7

It is especially simple to operate and use device 1 for dispensing refrigerating elements 10. Before the device is placed into service, refrigeration and storage module 6 is filled with refrigerating elements 10 charged with frigories that have been previously stored on palettes in freezers. Using an access door (not shown), these refrigerating elements 10 can be placed directly on helicoidal rail 80 and in guide tube 90.

Next, when the user needs one or more refrigerating elements 10, he or she pushes one or more times on the button or touchpad corresponding to table 22 of desk 21 and the dispensing device automatically ejects one or more refrigerating elements 10 through output orifice 7. The button or touchpad sends signals to the cylinder which generates alternate displacement by runner 95. In the resting position (FIG. 6A), the runner is lowered. When it is displaced, it executes one cycle comprising an upward movement to the top followed by a downward movement to the bottom. During the upward movement from the lowered position (FIG. 6A) to the upper position (FIG. 6B), with projecting element 94 extending from guide tube 90, it lifts with it the column of refrigerating elements 10 contained in the tube by pushing it out the top through output opening 7. Simultaneously, window 92 is engaged and ready to receive another refrigerating element 10 automatically and by gravitational force from helicoidal rail 80 (FIG. 6B). Projecting element 94 is disposed so that it lodges in slot 11 of refrigerating element 10 located in window 92 of guide tube 90. When raised, projecting element 94 comes into contact with traversing orifice 14 in said refrigerating element 10 on contact area 15. Its upper surface is essentially horizontal so it can exert a lifting force in the axis of guide tube 90. The extended position of projection 94 is defined by rod 97 which limits its rotation by forming a back stop. When runner 95 reaches the upper position (FIG. 6B), its movement is reversed and it redescends to the lowered position. During its return trip (FIG. 6C), the lower surface of projection 94 abuts refrigerating elements 10 contained in guide tube 90, automatically causing projection 94 to rotate into its collapsed or retracted position inside support 96 so as to disengage the projection from guide tube 90. Once in the lowered position, runner 95 may, if necessary, begin another cycle to eject another refrigerating element 10. Since this transfer device 9 is located within refrigeration and storage module 6, refrigeration elements 10 stored in guide tube 90 remain at the same temperature.

To recycle refrigerating elements 10 when the frigories have been discharged, the user introduces them into input orifice 3 after having positioned them correctly. Refrigerating elements 10 descend one by one, by gravity, along inclined ramp 50 to output opening 4. Simultaneously, presence detector 30, located at the back of input orifice 3, automatically sends signals to the cylinder of runner 95 to effect the exchange of refrigerating elements 10, as well as to motor 55 which controls the cleaning and disinfection mechanism, that is, brushes 53 and the simultaneously sprayed liquid disinfectant. Thus, refrigerating elements 10 are cleaned and disinfected before being introduced into refrigeration and storage module 6 through input orifice 4. This prevents any contamination of the refrigeration zone. Input and disinfection module 2 is completely separated and isolated from refrigeration and storage module 6. Thus, the electric and electronic equipment provided in this module can be standard equipment.

When refrigerating elements 10 pass from one module to the other through orifice 4, they fall directly by gravity onto helicoidal rail 80 where they overlap one another, an arrangement which allows a considerable number of refrigerating elements to be stored one behind the other while they are recharged with frigories. This transfer means 8 is advantageous because it requires no drive means, since refrigerating elements 10 are displaced by simple gravitational force.

From this description it is apparent that the invention achieves all its objectives and in particular, that the specific design of the two modules 2 and 6, as well as the positioning of input and output orifices 4 and 7 at the upper part of insulated case 60, increases refrigeration power considerably.

It would also be possible to replace third transfer module 9 by some other equivalent means of transfer that is not sensitive to low temperature.

What is claimed is:

1. An apparatus (1) for dispensing rechargeable refrigerating elements (10), especially plates or packets containing a substance formulated to accumulate frigories, comprising at least:

an input and disinfection module (2) for said refrigerating elements (10) provided with an input opening (3), an output opening (4), and a first means (5) for transferring the elements between the two orifices; and a refrigeration and storage module (6) for the refrigerating elements (10) provided with an insulated case (60), a cold generating device for charging the refrigerating elements with frigories, an input orifice (4) corresponding to the output orifice of the input and disinfection module (2), and an output orifice (7), the orifices (4,7) traversing a wall (61) of the insulated case (60); and with a second transfer mechanism (8) using gravity to transport the refrigeration elements (10) for recycling inside the refrigeration and storage module, characterized in that the inlet and disinfection module (2) is located above the refrigeration and storage module (6), in that the input (4) and output (7) orifices of the refrigeration and storage module (6) are located in the upper portion of the module, and in that the refrigeration and storage module (6) comprises a third transfer means (9) for lifting the refrigerating elements to the input orifice.

2. A dispensing apparatus according to claim 1, wherein the input orifices (4) and output orifices (7) of the refrigeration and storage module (6) are generally located in the same plane.

3. The dispensing apparatus according to claim 1, wherein the first transfer mechanism (5) comprises an inclined ramp (50) for transferring the refrigerating elements (10) from the input orifice (3) to the output orifice (4) using gravity.

4. The dispensing apparatus according to claim 3, wherein the input and disinfection module (2) comprises a cleaning device comprising two circular brushes (53) arranged symmetrically in relation to the inclined ramp (50) along the path of the refrigerating elements (10), each brush (53) being attached to a rotating plate (54) driven by a motorized device (55).

5. The dispensing apparatus according to claim 4, wherein the input orifice (3) comprises a presence detector (30) for transmitting a signal to the motorized means (55) of the cleaning device when a refrigerating element (10) is detected.

6. The dispensing apparatus according to claim 5, wherein the presence detector (30) comprises an articulated angled finger (31) subjected to a recall spring disposed so that its free extremity is located at the rear of the input orifice (3) along the path of the refrigerating elements (10), and at least one micro switch (32).

7. The dispensing apparatus according to claim 1, wherein the input orifice (4) of the refrigeration and storage module (6) comprises a sealed door consisting of a flexible spline (41) which opens under the weight of a refrigerating element (10).

8. The dispensing apparatus according to claim 1, wherein the second transfer mechanism (8) consists of a helicoidal rail (80) extending inside the case of its input orifice (4) from the upper portion to the lower portion, said rail receiving the generally vertical refrigerating elements (10) in overlapping arrangement on its upper generatrix (81).

9. The dispensing apparatus according to claim 3, wherein the input orifice (4) of the storage and refrigeration module (6) is disposed along a generally vertical axis, and in that the inclined ramp (50) of the first transfer mechanism (5) forms an acute angle with the axis of the input orifice (4).

10. The dispensing apparatus according to claim 1, wherein the third transfer mechanism (9) comprises a guide tube (90) extending inside the insulated case (60) from its lower portion to its output orifice (7), at the upper portion, and receiving the vertically positioned, superimposed refrigerating elements (10), with the lower portion of the guide tube (90) comprising a window (92) located opposite the lower extremity of the helicoidal rail (80), as well as a lifting device (93) for lifting the refrigerating elements (10) superimposed inside the guide tube (90) to accommodate another refrigerating element (10) arriving from the helicoidal rail (80).

11. The dispensing apparatus according to claim 8, wherein the lower extremity of the helicoidal rail (80) is rectilinear and disposed generally perpendicular to the window (92) in the guide tube (90).

12. The dispensing apparatus according to claim 10, wherein the lifting device (93) comprises a retractable projecting element (94) articulated to the end of a runner (95) attached inside a support (96) disposed parallel to and at the rear of a guide tube (90), the runner (95) being driven in alternating translational back and forth motion between a lower position and an upper position, and the projecting element (94) moving between two positions, an extended position where it projects inside the guide tube (90) moving forward and a returned position where it is retracted inside the support (96) during its return.

13. The dispensing apparatus according to claim 12, wherein the cleaning device (93) comprises a stop (97) which limits rotation by the articulated projecting element (94) in the extended position.

14. The dispensing apparatus according to claim 13, wherein the articulated projecting element (94) has a generally triangular shape such that when it is in the extended position, its upper surface is generally horizontal and when in the retracted position, its lower surface is essentially vertical, the two surfaces together defining an acute angle.

15. The dispensing apparatus according to claim 10, wherein the output orifice (7) comprises a sealed door (71) which opens when pushed by a refrigerating element (10) stored in the guide tube (90).

16. The dispensing apparatus according to claim 15, wherein the sealed door (71) slides inside an inclined support (72) located outside the insulated case (60), and in that it comprises at the extremity which blocks the output orifice (7) a bisected surface (73) that moves backward when pushed by the refrigerating element (10).

17. The dispensing apparatus according to claim 16, wherein the output orifice (7) is disposed along an essentially vertical axis and in that the inclined support (72) forms an acute angle with the axis of the output orifice.

* * * * *